US006439612B1

(12) United States Patent
Greer

(10) Patent No.: US 6,439,612 B1
(45) Date of Patent: Aug. 27, 2002

(54) BOOK HOLDER

(76) Inventor: Edwin Clarence Greer, 5047 Parkhurst Dr., Santa Rosa, CA (US) 95409

( * ) Notice: Subject to any disclaimer, the term of this patent is extended or adjusted under 35 U.S.C. 154(b) by 0 days.

(21) Appl. No.: 09/852,557

(22) Filed: May 10, 2001

(51) Int. Cl.[7] ..... B42D 3/00

(52) U.S. Cl. ..... 281/45; 206/449; 224/277; 281/42; 281/44; 462/71

(58) Field of Search ..... 281/42, 44, 45, 281/49; D19/78; 224/277; 206/449; 462/71, 72

(56) References Cited

U.S. PATENT DOCUMENTS 4,102,071 A * 7/1978 D'Arcy ..... 40/531
4,512,542 A * 4/1985 Black ..... 248/460
4,588,074 A * 5/1986 Strong et al. ..... 206/45.2
4,951,968 A * 8/1990 Adams ..... 281/45
4,997,088 A * 3/1991 Spry ..... 206/449
5,445,416 A * 8/1995 Zareck ..... 281/12
5,458,312 A * 10/1995 Goldberg ..... 248/444.1
5,474,333 A * 12/1995 Schrader ..... 281/45
5,590,910 A * 1/1997 Meth ..... 281/45
5,797,631 A * 8/1998 Lander ..... 281/42
6,109,658 A * 8/2000 Moore ..... 281/42
6,283,432 B1 * 9/2001 Hoose, Jr. ..... 248/441.1
2001/0023916 A1 * 9/2001 Armstrong ..... 248/447.1

* cited by examiner

*Primary Examiner*—A. L. Wellington
*Assistant Examiner*—Monica S. Carter
(74) *Attorney, Agent, or Firm*—Risto A. Rinne, Jr

(57) ABSTRACT

An apparatus for supporting a book or magazine for reading includes a bottom member and a top member. The top member is elevated at one end above the bottom member and is adapted to pivot from a first closed position for reading into a second open position for turning the pages. At least a portion of the top member is transparent to permit viewing of printed matter through the top member, which is adapted to press upon the book or magazine when it is disposed in the first position. A lip is attached to the bottom member and is used to further retain the book or magazine in position. A receiving member is optionally attached to a back of the bottom member and is used to attach either a leg or a handle thereto.

11 Claims, 2 Drawing Sheets

BOOK HOLDER

BACKGROUND OF THE INVENTION

1. Field of the Invention

The present invention, in general relates to devices that are used with a book and, more particularly, to devices that hold a book open for reading.

There is a long standing need to hold a book open for reading. As almost everyone is aware, the pages of a book tend to close of their own, due to forces that are imparted to the pages primarily by the binding.

As a result, the reader must deliberately maintain the pages in an open position. This can be, at times, inconvenient. At least one hand is generally required to maintain the pages open.

There is a need for a book holder to hold the pages open for use with either a hard cover type of a book, a paperback book, or a magazine.

Because the overall size (including the thickness) of the various books and magazines are extensive, it is desirable for a book holder to be able to accommodate the great variety of books and magazines that may be encountered.

If a prior type of a book holder has either complex members or other types of moving members to accommodate these different types and sizes of books and magazines, whatever members may be used to hold the pages of the book open will tend to obscure the printed material when these prior types of holders are used with still other types and sizes of books.

Therefore, there is a need to be able to accommodate different types and sizes of books and magazines so as to be able to hold the pages open while not obscuring the print that appears on any of the pages.

A similar problem mentioned briefly hereinabove and related to the size of the book that is being supported is that the thickness of the book (and binding) can prevent a book holder from properly closing (i.e., securing the pages in an open position) around the book for optimum reading comfort. Therefore, it may not properly accommodate the thickness of the book.

Accordingly, there is a need for a book holder that is inexpensive to manufacture.

There is a further need for a book holder that is aesthetically pleasing in its appearance.

There is also a further need for book holder that includes a straight edge. This is useful to underline text, when desired. A person reading a text book, for example, may wish to "highlight" certain passages for future study.

Furthermore, there are times when it is desirable to rest the book on a bed or a desk or similar object without the reader having to physically hold it. It is desirable to be able to hold the pages in an open position at such times and also to permit rapid turning of the pages when necessary.

A book holder that includes a way to support the book holder on a bed, table, or other surface in the desired attitude and hold the pages open is preferred. However, when such support is not required, it is desirable to either fold or remove such support (for example, when transporting the book holder from place to place).

There are other times when it is desirable not to rest the book upon a surface but to be able to hold it with only one hand. However, the conventional hand posture for holding a book requires that part of the hand be used to maintain the pages in an open position while the rest of the hand is used to support the full weight of the book. For many readers, the hand must raise the book to a height that requires great strain to maintain and to support. Ideally, a book holder that includes a convenient hand-hold and which holds the pages open is desirable.

This is especially true if the hand-hold mechanism allows the reader to support the book with their hand at a lower position. Their hand could then even rest directly upon a surface. Then, the reader would primarily be required only to balance the book (rather than lift and to support its weight).

Accordingly, there exists today a need for a book holder that can ameliorate as many of these problems as is possible and do so at as low a cost as is possible.

Clearly, such an apparatus would be a useful and desirable device.

2. Description of Prior Art

Book holders are, in general, known. For example, the following patent describe various types of these devices:

U.S. Pat. No. 6,109,658 to Moore, Aug. 29, 2000.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a book holder that is inexpensive to manufacture.

It is also an important object of the invention to provide a book holder that is adapted for use with a book.

Another object of the invention is to provide a book holder that is adapted for use with a magazine.

Still another object of the invention is to provide a book holder that is adapted for use with a hardcover type of a book.

Still yet another object of the invention is to provide a book holder that is adapted for use with a softcover type of a book.

Yet another important object of the invention is to provide a book holder that is adapted for placement directly upon a bed, desk, or other type of a surface.

Still yet another important object of the invention is to provide a book holder that is adapted for use with a handle (i.e., a hand-hold mechanism).

It is a first continuing object of the invention to provide a book holder that is adapted for use with a leg.

It is a second continuing object of the invention to provide a book holder that includes a leg that can be removed.

It is a third continuing object of the invention to provide a book holder that includes a handle (i.e., a hand-hold mechanism) that can be removed.

It is a fourth continuing object of the invention to provide a book holder that includes a handle (i.e., a hand-hold mechanism) that can be folded flat.

It is a fifth continuing object of the invention to provide a book holder that includes a leg that can be folded flat.

It is a sixth continuing object of the invention to provide a book holder that is adapted for use with various sizes of books and magazines.

It is a seventh continuing object of the invention to provide a book holder that is adapted to accommodate the thickness of the binding.

It is an eighth continuing object of the invention to provide a book holder that includes a member that covers a portion of the pages that is transparent.

It is an ninth continuing object of the invention to provide a book holder that includes a lip attached to a bottom member that is adapted to retain a book thereon.

It is an tenth continuing object of the invention to provide a book holder that can automatically adapt for use with books having a wide range of thickness'.

Briefly, a book holder that is constructed in accordance with the principles of the present invention has a planar bottom member upon which a book or a magazine is placed. A first end of a substantially planar top member is disposed a predetermined distance above a first end of the bottom member. The top member is adapted to pivot about an axis or plurality of axes that are disposed proximate the first end thereof. The top member is adapted to pivot with respect to the bottom member between a first closed position that is adapted for reading and a second open position that is adapted for turning a page or removing or inserting the book. At least a portion of the top member is transparent, through which a printed matter may be read. A lip is attached to a bottom edge of the bottom member and is used to retain the book thereon. A great many various shapes and styles are anticipated. According to a modification, a detachable leg is pivotally attachable to a receiving member that is attached to a back of the bottom member. The leg may be removed and a handle inserted into the receiving member to replace the leg.

DETAILED DESCRIPTION OF THE INVENTION

Figure 1:
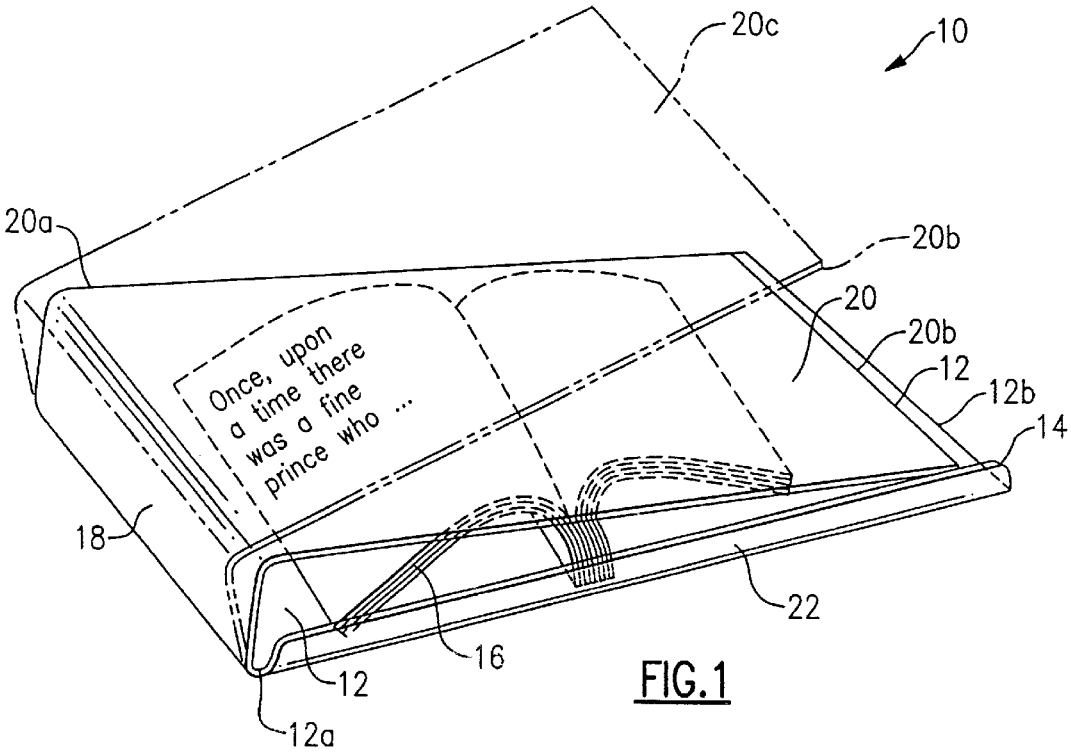
FIG. 1 is a view in perspective of a book holder with a top member (shown in two positions) above a bottom member and a book disposed therein.

Referring to all of the FIGURE Drawings and in particular now to FIG. 1 is shown, a book holder, identified in general by the reference numeral 10.

The book holder 10 includes a substantially planar bottom member 12.

A raised lip 14 extends along a bottom edge of the bottom member 12 and is used to retain a book 16 in position. The book 16 (as shown) is intended to include any type of a hard or soft cover book or magazine.

A first end of the bottom member 12*a* includes a first member 18 that is attached to the bottom member 12 and which extends therefrom a predetermined distance.

A top member 20 is attached at a first end thereof 20*a* to the first member 18 at an end of the first member 18 that is disposed furthest away from the bottom member 12.

The size and shape of the first member 18 are variables that are selected to match the particular design of the book holder 10.

The first member 18 is preferably molded so as to be included as a unit that is formed integrally with both the bottom member 12 and the top member 20. This provides a smoother appearance, one that affords optimum aesthetic appeal.

The top member 20 is adapted to pivot proximate the first end thereof 20*a* with respect to the bottom member 12 about at least one axis. Accordingly, a hinge (not shown) may be used intermediate the top member 20 and the bottom member 12.

A preferable design is to utilize the elasticity that is inherent in the material that the top and bottom members 20, 12 are formed of to provide for the pivoting motion to occur.

Accordingly, the top member 20 preferably pivots about a plurality of axes that are in parallel longitudinal alignment with respect to each other and which are disposed intermediate the first end 12*a* of the bottom member 12 and the first end thereof 20*a* of the top member 20 (as well as throughout the entire height of the first member 18).

A slight flexing along the plurality of axes allows the top member 20 to be pivoted from a first closed position in which a second end thereof 20*b* that is opposite with respect to the first end thereof 20*a* is disposed proximate a second end 12*b* of the bottom member 12 into a second open position 20*c* (shown in dashed lines) in which the second end thereof 20*b* is disposed away from the bottom member 12 sufficient to allow the pages of the book 16 to be turned or for the book 16 to be either removed from or inserted in the book holder 10.

When the top member 20 is disposed in the first closed position, it is noted that the second end thereof 20*b* is disposed slightly in from the second end 12*b* of the bottom member 12. This allows a reader (not shown) to more easily separate the bottom member 12 apart from the top member 20 for pivoting the top member 20 into the second open position 20*c* . When the top member 20 is disposed in the first closed position, it presses upon the top of the book 16 and pinches the book intermediate the top member 20 and the bottom member 12, thereby securing the book 16 in position.

The raised lip 14 is attached to a bottom edge of the bottom member 12 and it extends along the bottom edge for a predetermined distance. The lip 14 includes a substantially planar upright member 22 that is preferably molded as an integral part of the bottom member 12 and is disposed at an angle with respect to the bottom member 12. Preferably, the angle is nearly ninety degrees (i.e., perpendicular).

The lip 14 prevents the book 16 from sliding out of the book holder 10 when a top of the book 16 is elevated with respect to a bottom of the book 16.

Figure 2:
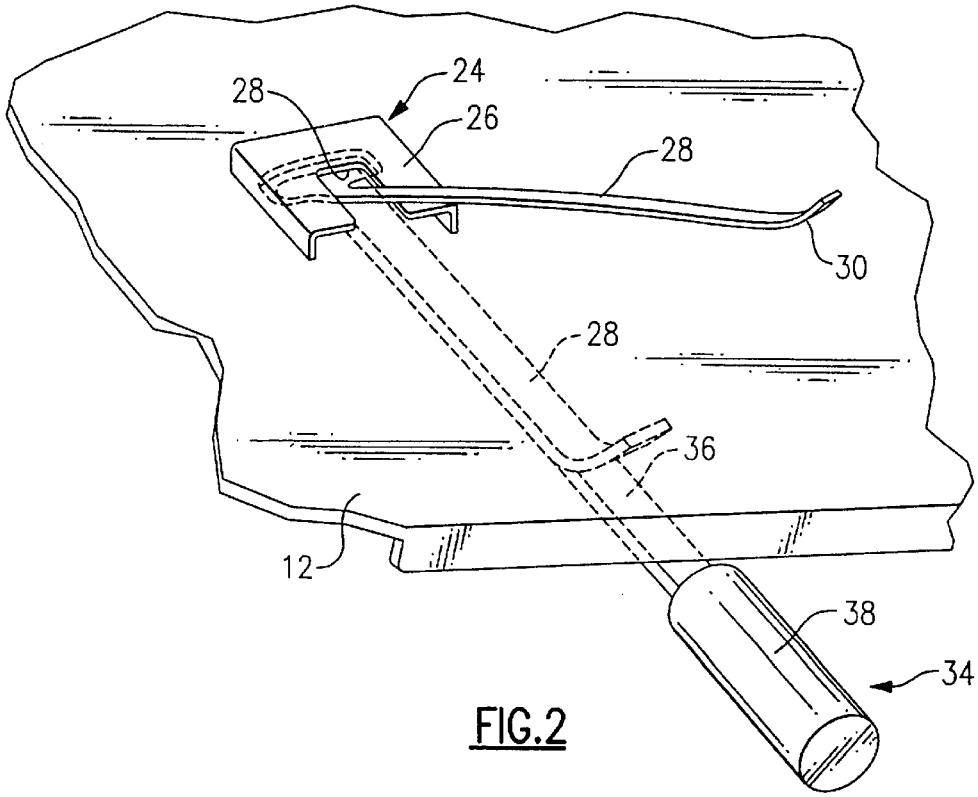
FIG. 2 is a view in perspective of a leg and handle attached to a receiving member that is optionally attached to the back of the bottom member that is shown in FIG. 1.

Referring now in particular to FIG. 2, is shown a receiving member, identified in general by the reference numeral 24, that is attached to a back of the bottom member 12. The back is the side that is disposed opposite to where the book 16 is placed.

The receiving member 24 may be molded into the bottom member as a component part thereof or it may be added later as an aftermarket accessory (i.e., sold and applied with an adhesive, for example).

The receiving member 24 includes a substantially planar portion 26 that is elevated above the back surface of the bottom member 12.

The planar portion 26 of the receiving member includes a "U-shaped" channel 28 that is formed therein.

A detachable leg 28 is inserted therein and is shown in an extended position (FIG. 2) where an arcuate end 30 is disposed away from the bottom member 12 and in a retracted position in which the arcuate end 30 is disposed proximate the bottom member 12.

If desired, the arcuate end 30 may, of course, be eliminated to produce a modified type of a straight leg. The advantage of the arcuate end 30 is that when it is placed on a desk or other surface it well supports the book holder 10 and the book 16 at both a stable and at an optimum viewing angle.

When the arcuate end 30 is eliminated, the advantage is that it allows the modified leg to fold nearly flush with the back of the bottom member 12 thereby providing a smoother, flatter, and more compact device.

Accordingly, the leg 28 (either version) may be supplied with the book holder 10 or sold as an after market accessory, of which the reader may select the preferred type.

Figure 3:
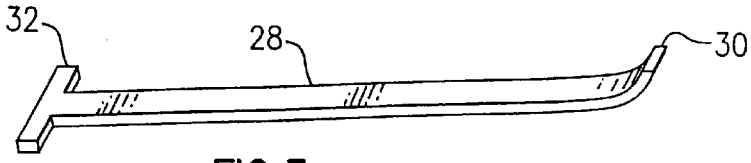
FIG. 3 is a view in perspective of the leg of FIG. 2, shown detached apart from the book holder.

Referring now also to FIG. 3, the leg 28 includes a round T-member 32 that is disposed perpendicular with respect to the a longitudinal axis of the leg 28.

The T-member 32 is adapted to fit intermediate the planar portion 26 and the back of the bottom member 12. Because it is round, it permits the leg 28 to rotate intermediate the two positions shown in FIG. 2.

Figure 4:
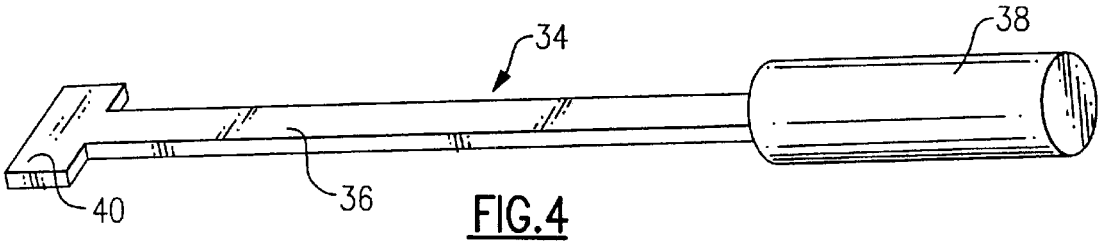
FIG. 4 is a view in perspective of the handle of FIG. 2, shown detached apart from the book holder.

Referring back to FIG. 2 and also to FIG. 4, is shown a handle, identified in general by the reference numeral 34.

The handle 34 includes a flat member 36 of a predetermined length that includes an optional molded grip 38 at one end thereof.

The handle 34 includes a flat T-member 40 that is disposed perpendicular with respect to the a longitudinal axis of the flat member 36. The flat T-member 40 fits snugly intermediate the planar portion 26 and the back of the bottom member 12. Accordingly, the handle 34 cannot pivot away from the back of the bottom member 12 but rather is held flush against the back of the bottom member 12.

By offering a plurality of the handles 34 for sale, each with a different longitudinal length, the reader is able to select the one that is preferred and which provides optimum reading comfort.

Both the handle 34 and the leg 28 are detachably-attachable with respect to the book holder 10. They are each inserted by pushing either the round T-member 32 (of the leg 28) or the flat T-member 40 (of the handle 34) into the receiving member 24, as desired and pulling the handle 34 or the leg 28 out, when desired.

Accordingly, either the handle 34 or the leg 28 may be used to replace the other or both may be eliminated, when desired.

Figure 5:
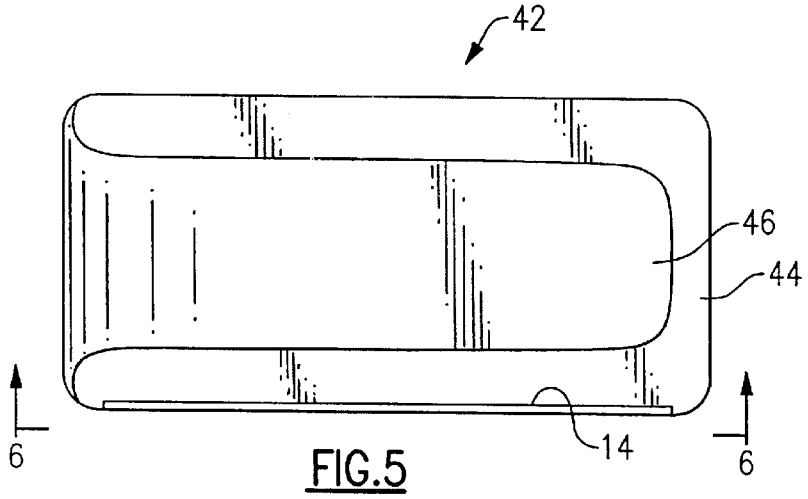
FIG. 5 is a top plan view of a first modified book holder.
Figure 6:
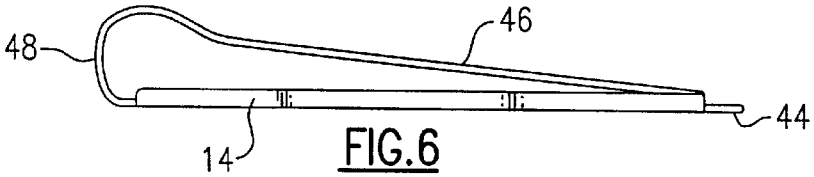
FIG. 6 is a view as shown in FIG. 5 as seen along the lines 6—6 therein.

Referring now to FIG. 5 and FIG. 6 is shown a first modified book holder 42 in which a first modified bottom member 44, a first modified top member 46, and a first modified first member 48 are used.

The first modified top member 46 is considerably smaller than the first modified bottom member. The first modified book holder 42 is used to illustrate some of the variety of form possible.

Figure 7:
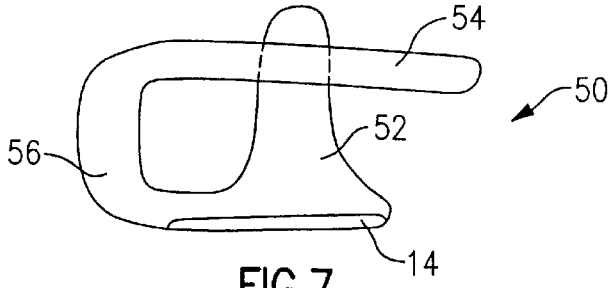
FIG. 7 is a is a top plan view of a second modified book holder.

Referring now to FIG. 7, a second modified book holder 50 in which a second modified bottom member 52, a second modified top member 54, and a second modified first member 56 are used to further illustrate the variety possible.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A book holder adapted for receiving a printed matter, comprising:

(a) a substantially planar bottom member adapted to receive said printed matter;

(b) a substantially planar top member disposed above said bottom member; and (c) a first member attached at one end thereof to a first end of said bottom member and attached at an opposite end thereof to a first end of said top member, wherein said first end of said top member is disposed a predetermined distance above said first end of said bottom member and wherein said top member is adapted to pivot at said first end with respect to said bottom member about a plurality of axes from a first closed position in which second end of said top member is urged toward said bottom member into a second open position in which said second end of said top member is disposed away from said bottom member and wherein at least a portion of said top member is transparent.

2. The book holder of claim 1 wherein said bottom member includes a lip and wherein said lip is adapted to retain said printed matter atop said bottom member.

3. The book holder of claim 1 wherein said bottom member includes a receiving member, said receiving member adapted to receive a leg therein.

4. The book holder of claim 3 wherein said leg is adapted to pivot from a first closed position wherein said leg is disposed substantially in parallel alignment with respect to said bottom member into a second open position wherein a distal end of said leg is disposed away from said bottom member.

5. The book holder of claim 3 wherein said leg is detachably attachable with respect to said receiving member.

6. The book holder of claim 1 wherein said bottom member includes a receiving member, said receiving member adapted to receive a handle therein.

7. The book holder of claim 6 wherein said handle is disposed substantially in parallel alignment with respect to said bottom member.

8. The book holder of claim 6 wherein said handle is detachably attachable with respect to said receiving member.

9. The book holder of claim 1 wherein said bottom member extends further away from said first member than does said top member.

10. The book holder of claim 1 wherein said top member is adapted to press upon a portion of said book when said top member is disposed in said first closed position.

11. A book holder adapted for receiving a printed matter, comprising:

(a) a substantially planar bottom member adapted to receive said printed matter and wherein said bottom member includes a receiving member, said receiving member adapted to receive a leg therein and wherein said leg is adapted to pivot from a first closed position wherein said leg is disposed substantially in parallel alignment with respect to said bottom member into a second open position wherein a distal end of said leg is disposed away from said bottom member;

(b) a substantially planar top member disposed above said bottom member; and (c) a first member attached at one end thereof to a first end of said bottom member and attached at an opposite end thereof to a first end of said top member, wherein said first end of said top member is disposed a predetermined distance above said first end of said bottom member and wherein said top member is adapted to pivot at said first end with respect to said bottom member from a first closed position in which said a second end of said top member is urged toward said bottom member into a second open position in which said second end of said top member is disposed away from said bottom member and wherein at least a portion of said top member is transparent.

* * * * *